US012495937B2

(12) United States Patent
Chang et al.

(10) Patent No.: US 12,495,937 B2
(45) Date of Patent: Dec. 16, 2025

(54) UNDERNEATH LARGE-CAPACITY SINGLE-GAS-PUMP FOAM GENERATING DEVICE

(71) Applicant: FANER AROMA PRODUCT CO., LTD., Guangdong (CN)

(72) Inventors: Hsu-hui Chang, Guangdong (CN); Senlin Yang, Guangdong (CN); Siying Feng, Guangdong (CN); Songwen Ye, Guangdong (CN); Yongfu Huang, Guangdong (CN)

(73) Assignee: FANER AROMA PRODUCT CO., LTD., Guangdong (CN)

( * ) Notice: Subject to any disclaimer, the term of this patent is extended or adjusted under 35 U.S.C. 154(b) by 307 days.

(21) Appl. No.: 18/039,439

(22) PCT Filed: Nov. 9, 2021

(86) PCT No.: PCT/CN2021/129528
§ 371 (c)(1),
(2) Date: May 30, 2023

(87) PCT Pub. No.: WO2023/082041
PCT Pub. Date: May 19, 2023

(65) Prior Publication Data
US 2024/0090713 A1 Mar. 21, 2024

(51) Int. Cl.
*A47K 5/14* (2006.01)
*A47K 5/12* (2006.01)

(52) U.S. Cl.
CPC ..... *A47K 5/14* (2013.01); *A47K 5/1211* (2013.01)

(58) Field of Classification Search
CPC ..... A47K 5/14; A47K 5/1211; A47K 5/12; B01F 23/2323; B01F 25/45;
(Continued)

(56) References Cited

U.S. PATENT DOCUMENTS 5,222,633 A * 6/1993 Blake ..... B01F 25/3121 222/400.8
5,398,845 A 3/1995 Meyer
(Continued)

FOREIGN PATENT DOCUMENTS

CN 101370595 A 2/2009
CN 101449940 A 6/2009
(Continued)

OTHER PUBLICATIONS

International Search Report of International Application No. PCT/CN2021/129528, mailed Jul. 6, 2022, with English Translation, 7 pages.
(Continued)

*Primary Examiner* — Bob Zadeh
(74) *Attorney, Agent, or Firm* — Quarles & Brady LLP

(57) ABSTRACT

An underneath large-capacity single-gas-pump foam generating device includes a liquid replenishment mechanism and a foam generating mechanism. The liquid replenishment mechanism includes a liquid replenishment groove and a liquid replenishment bottle. The liquid replenishment bottle has a bottle opening sleeved in the liquid replenishment groove. The foam generating mechanism includes a gas supply pump unit, a gas mixing groove cavity, a gas-liquid mixing structure, a gas inlet and a vent valve structure. A lower portion of the gas mixing groove cavity is communicated with a lower portion of the liquid replenishment groove, a liquid replenishment one-way valve is arranged between the gas mixing groove cavity and the liquid replenishment groove. The gas-liquid mixing structure is provided with a liquid outlet channel, a gas outlet channel and a mixing channel, an inlet end of the liquid outlet channel extends downwardly into a bottom portion of the gas mixing groove cavity.

9 Claims, 6 Drawing Sheets

(58) Field of Classification Search
CPC .. B01F 35/71745; B01F 23/235; F04B 13/02; F04B 53/1065; F04F 1/18; B05B 7/0031; B05B 11/0039; B05B 11/1087; F16K 15/148
See application file for complete search history.

(56) References Cited

U.S. PATENT DOCUMENTS

| | | | | | |
|---|---|---|---|---|---|
| 5,544,788 | A * | 8/1996 | Meyer | B67D 99/00 222/110 |
| 5,842,607 | A | 12/1998 | Snider | |
| 5,984,146 | A * | 11/1999 | Kaufman | G01F 11/262 222/215 |
| 6,361,688 | B1 * | 3/2002 | Nelson | B01F 25/103 210/194 |
| 9,586,217 | B2 * | 3/2017 | Arminak | B05B 7/267 |
| 2009/0145296 | A1 | 6/2009 | Ophardt | |
| 2012/0267396 | A1 | 10/2012 | Quinlan, Jr. | |
| 2014/0203047 | A1 | 7/2014 | McNulty | |
| 2018/0360276 | A1 | 12/2018 | Yang | |
| 2019/0159636 | A1 | 5/2019 | Lo | |
| 2024/0090713 | A1 * | 3/2024 | Chang | B01F 23/2323 |

FOREIGN PATENT DOCUMENTS

| | | | | | |
|---|---|---|---|---|---|
| CN | 102287365 | A | | 12/2011 | |
| CN | 105054840 | A | | 11/2015 | |
| CN | 105935269 | A | | 9/2016 | |
| CN | 106419694 | A | | 2/2017 | |
| CN | 208032848 | U | | 11/2018 | |
| CN | 110359531 | A | | 10/2019 | |
| CN | 110638357 | A | | 1/2020 | |
| CN | 211484275 | U | | 9/2020 | |
| CN | 211852906 | U | | 11/2020 | |
| CN | 213309370 | U | | 6/2021 | |
| CN | 214342032 | U | | 10/2021 | |
| CN | 214549178 | U | | 11/2021 | |
| GB | 2335005 | A | * | 9/1999 | A47K 5/14 |
| JP | H0315636 | U | | 2/1991 | |
| JP | H05337058 | A | | 12/1993 | |
| WO | WO-8101993 | A | * | 7/1981 | A47K 5/12 |

OTHER PUBLICATIONS

Written Opinion of the International Search Authority of International Application No. PCT/CN2021/129528, mailed Jun. 24, 2022, 4 pages.
First Office Action in CN Application No. 202180006571.4, dated Jan. 19, 2023, 9 pages.
Japanese Patent Office. Notice of Reasons for Refusal mailed in JP Application No. 2024-548795 on Mar. 3, 2025, 10 pages.
European Patent Office. Extended European Search Report mailed in EP Application No. 21963498.7 on Oct. 24, 2024, 9 pages.

* cited by examiner

UNDERNEATH LARGE-CAPACITY SINGLE-GAS-PUMP FOAM GENERATING DEVICE

CROSS-REFERENCE TO RELATED APPLICATIONS

This application is a national stage filing under 35 U.S.C. § 371 of international application number PCT/CN2021/129528, filed Nov. 9, 2021, the contents of which are incorporated herein by reference in its entirety.

TECHNICAL FIELD

The disclosure relates to the field of bathroom products, and particularly to an underneath large-capacity single-gas-pump foam generating device.

BACKGROUND

Bath lotion, shampoo or hand sanitizer used in traditional bathroom is packed in a package bottle or a special storage and supply device, and extruded by manual pressing. The extruded bath lotion, shampoo or hand sanitizer is in a liquid state, and foamed by rubbing, which has the disadvantages of uneven foaming and unsatisfactory cleaning effect. There are some automatic foams generating devices in the existing market, which are realized by a foam pump, and have the disadvantages of low capacity, frequent liquid replenishment and high manufacturing cost.

SUMMARY

The disclosure aims to provide an underneath large-capacity single-gas-pump foam generating device to solve one or more technical problems in the existing technology, and at least provide a beneficial selection or creation condition.

A technical solution used to solve the above technical problems is as follows.

The disclosure provides an underneath large-capacity single-gas-pump foam generating device, which comprises: a liquid replenishment mechanism and a foam generating mechanism, wherein the liquid replenishment mechanism comprises a liquid replenishment groove and a liquid replenishment bottle, the liquid replenishment groove is provided with a sleeve port with an upward opening, a lower end of the liquid replenishment bottle is sleeved in the liquid replenishment groove from the sleeve port, the liquid replenishment groove is communicated with outside, and the lower end of the liquid replenishment bottle is provided with a bottle opening; and the foam generating mechanism comprises a gas supply pump unit, a gas mixing groove cavity, a gas-liquid mixing structure arranged at an upper portion of the gas mixing groove cavity, a gas inlet and a vent valve structure, a lower portion of the gas mixing groove cavity is communicated with a lower portion of the liquid replenishment groove, a liquid replenishment one-way valve is arranged between the gas mixing groove cavity and the liquid replenishment groove, the liquid replenishment one-way valve has a flowing direction from the liquid replenishment groove to the gas mixing groove cavity, the gas supply pump unit is connected with the gas inlet, the vent valve structure communicates the gas mixing groove cavity with the outside, the gas-liquid mixing structure is provided with a liquid outlet channel, a gas outlet channel and a mixing channel, an inlet end of the liquid outlet channel extends downwardly into a bottom portion of the gas mixing groove cavity, an inlet end and a gas inlet of the gas outlet channel are both communicated with the upper portion of the gas mixing groove cavity, and an outlet end of the liquid outlet channel and an outlet end of the gas outlet channel are respectively communicated with an inlet of the mixing channel.

The disclosure has the beneficial effects as follows. When foam needs to be sprayed out, the gas supply pump unit performs air pressurization on the gas mixing groove cavity to increase an internal pressure of the gas mixing groove cavity, the vent valve structure is closed at the moment, a soap liquid in the gas mixing groove enters the mixing channel from the liquid outlet channel under the pressure, gas in the gas mixing groove cavity enters the mixing channel from the gas outlet channel under the pressure at the same time, and the gas and the soap liquid are mixed in the mixing channel to form the foam and then sprayed out of the mixing channel together to realize foam spraying. When the soap liquid in the gas mixing groove cavity is sprayed out, a liquid level of the soap liquid in the gas mixing groove cavity will be lowered, the soap liquid in the liquid replenishment groove is supplied into the gas mixing groove cavity through the liquid replenishment one-way valve under an action of an atmospheric pressure at the moment, until air pressure balance is reached between the gas mixing groove cavity and the liquid replenishment groove, which means that liquid level heights of the gas mixing groove cavity and the liquid replenishment groove are consistent, and the vent valve structure remains open at the moment to communicate the gas mixing groove cavity with the outside. When the soap liquid in the liquid replenishment groove is supplied to the gas mixing groove cavity, because the bottle opening at the lower end of the liquid replenishment bottle is sleeved in the liquid replenishment groove from the sleeve port, the soap liquid in the liquid replenishment bottle can be replenished into the liquid replenishment groove when the liquid level in the liquid replenishment groove is lowered, until the liquid level height in the liquid replenishment groove exceeds the bottle opening, and then liquid replenishment is stopped, so as to ensure an amount of the soap liquid in the liquid replenishment groove. The foam generating device can generate foam through a single gas supply pump unit, and under the action of the atmospheric pressure, automatic liquid supply and replenishment can be realized among the liquid replenishment bottle, the liquid replenishment groove and the gas mixing groove cavity through a mechanical structure, so that large-capacity use can be realized, without needing frequent liquid replenishment.

As a further improvement of the above technical solution, the vent valve structure comprises a vent channel communicating the gas mixing groove cavity with the outside and a counterweight blocking body movably arranged in the vent channel up and down, the vent channel is provided with a vent outlet and a vent inlet which are arranged up and down, and the counterweight blocking body is used for moving upwardly to block the vent outlet under an force of high-pressure gas in the gas mixing groove cavity.

In this solution, the vent valve structure is mechanically closed through the counterweight blocking body. When the liquid replenishment groove supplies liquid to the gas mixing groove cavity, an air pressure in the gas mixing groove cavity is relatively low, and the counterweight blocking body may be pushed up by the air pressure at the moment but is not pushed up to block the vent outlet, so that the vent channel is in a communication state, the gas mixing groove cavity is communicated with the outside at the moment, and the liquid replenishment groove can supply liquid to the gas mixing groove cavity. When the gas supply pump unit performs air pressurization on the gas mixing groove cavity, the air pressure in the gas mixing groove cavity is very high, and high-pressure gas may push the counterweight blocking body up, so that the counterweight blocking body blocks the vent outlet, the vent channel is in a closed state at the moment, and the foam generating device is in a foam spraying state. A weight of the counterweight blocking body may be determined by those of ordinary skills in the art according to an actual working air pressure, which will not be described in detail in the disclosure.

As a further improvement of the above technical solution, the vent inlet is provided with an annular bearing step for supporting the counterweight blocking body, and the counterweight blocking body is spherical. The annular bearing step mainly serves to support the counterweight blocking body, thus avoiding the counterweight blocking body from falling down, and ensuring that the counterweight blocking body can be pushed up by the gas, wherein the vent outlet has a trumpet-shaped structure with a small top and a large bottom. A vent gap is formed between the spherical counterweight blocking body and an inner wall of the vent channel.

As a further improvement of the above technical solution, the gas-liquid mixing structure comprises a sleeving groove arranged in the top portion of the gas mixing groove cavity and a hollow sleeving member sleeved in the sleeving groove, the mixing channel is arranged at a top portion of the sleeving groove and communicated with the sleeving groove, the gas outlet channel is arranged between an outer wall of the sleeving member and an inner wall of the sleeving groove, the sleeving member is connected with a liquid outlet pipe, and the liquid outlet channel is formed in the liquid outlet pipe and the sleeving member.

In this solution, the gas-liquid mixing structure mainly realizes gas-liquid mixing, and is formed by sleeving the sleeving member in the sleeving groove at the top portion of the gas mixing groove cavity, thus being simpler in structure, which can be manufactured without using a complicated mold.

In other solutions, the vent valve structure comprises a sleeve arranged on an outer wall of the upper portion of the gas mixing groove cavity, a sleeving column fixed on the outer wall of the gas mixing groove cavity is arranged in the sleeve, a sleeving gap is formed between the sleeve and the sleeving column, a bottom portion of the sleeving gap is provided with a vent groove opening communicated with the gas mixing groove cavity, an inverted barrel-shaped vent sleeve is arranged in the sleeving gap, a top portion of the vent sleeve is provided with a micro vent hole structure, an outer peripheral wall of the vent sleeve hermetically abuts against an inner peripheral wall of the sleeve, a plurality of vent groove channels are formed between an inner wall of the vent sleeve and an outer wall of the sleeving column, and two ends of each of the vent groove channels are respectively communicated with the micro vent hole structure and the vent groove opening.

In other solutions, the vent valve structure may also be a series of circulation control devices, such as an electromagnetic valve and a microporous membrane.

As a further improvement of the above technical solution, a plurality of gas outlet channels are provided, and the plurality of gas outlet channels are annularly arranged between the outer wall of the sleeving member and the inner wall of the sleeving groove at intervals.

The plurality of gas outlet channels can make the mixing of the gas and the soap liquid more uniform and sufficient, and the gas enters from a periphery of the mixing channel to be mixed with the soap liquid.

As a further improvement of the above technical solution, the bottle opening is provided with a liquid replenishment valve structure, and the liquid replenishment groove is provided with a liquid replenishment pushing structure for abutting against the liquid replenishment valve structure to open the liquid replenishment valve structure.

Because the liquid replenishment bottle is invertedly mounted, when the liquid replenishment bottle is replaced, the soap liquid may be spilled out if there is still the soap liquid inside the liquid replenishment bottle. In this solution, the liquid replenishment valve structure is arranged at the bottle opening, the bottle opening is opened if the liquid replenishment pushing structure pushes the liquid replenishment valve structure up, and when the liquid replenishment pushing structure is separated from the liquid replenishment valve structure, the liquid replenishment valve structure closes the bottle opening, thus avoiding the soap liquid from being spilled out.

Specifically, the liquid replenishment valve structure comprises a liquid replenishment valve cover sleeved on the bottle opening and a liquid replenishment valve core rod arranged in an up-down extending mode, the liquid replenishment valve cover is provided with a liquid replenishment valve port, a liquid replenishment elastic member is arranged between the liquid replenishment valve core rod and the liquid replenishment valve cover, an outer peripheral wall of the liquid replenishment valve core rod is provided with a blocking step, the liquid replenishment elastic member is used for providing a downward force to the liquid replenishment valve core rod, so that the blocking step blocks the liquid replenishment valve port, and a lower end of the liquid replenishment valve core rod extends out of the liquid replenishment valve port to abut against the liquid replenishment pushing structure.

In this solution, when the liquid replenishment valve structure is in a free state, the liquid replenishment elastic member makes the blocking step block the liquid replenishment valve port, and when a lower end of the liquid replenishment valve core rod abuts against the liquid replenishment pushing structure and pushes the liquid replenishment valve core rod up, the blocking step is separated from the liquid replenishment valve port, so that the liquid replenishment valve port is in a communication state.

A guide frame is fixedly arranged on an inner side of the liquid replenishment valve cover, the guide frame is provided with a first guide hole in up-down sliding fit with an upper end of the liquid replenishment valve core rod, an outer periphery of the liquid replenishment valve core rod is provided with an abutting step, and the liquid replenishment elastic member is arranged between the abutting step and a bottom portion of the first guide hole.

The liquid replenishment pushing structure comprises a liquid replenishment pushing platform arranged at a groove bottom of the liquid replenishment groove, and the liquid replenishment elastic member is a spring arranged around the liquid replenishment valve core rod.

As a further improvement of the above technical solution, the foam generating mechanism further comprises a foam refining unit, the foam refining unit is connected with an outlet of the mixing channel through a pipeline, the gas supply pump unit comprises a gas supply pump, and the gas supply pump is connected with the gas inlet through a gas pipe.

In this solution, the foam refining unit is further provided to perform foam refining on a mixture of the soap liquid and the gas.

As a further improvement of the above technical solution, the liquid replenishment one-way valve comprises an umbrella-shaped valve core arranged in an extending mode, and a liquid replenishment through hole and a second guide hole which are arranged at the top portion of the gas mixing groove cavity, the umbrella-shaped valve core comprises a valve cap and a valve rod, the valve rod is in up-down sliding fit with the second guide hole, the liquid replenishment through hole is arranged below the valve cap, the liquid replenishment through hole is communicated with the liquid replenishment groove, a plurality of liquid replenishment through holes are provided, and the plurality of liquid replenishment through holes are annularly arranged at intervals by taking an axis of the valve rod as a center.

In this solution, the liquid replenishment one-way valve is realized by the structure of the umbrella-shaped valve core, wherein the valve rod is in sliding fit with the second guide hole. When in a free state, the umbrella-shaped valve core moves downwardly by a self-gravity, the valve cap blocks the liquid replenishment through hole at the moment, and when a liquid is supplied, the liquid may push the umbrella-shaped valve core up, and the valve cap opens the liquid replenishment through hole at the moment. A lower end of the valve rod is provided with a limiting protrusion, which can avoid the umbrella-shaped valve core from being separated from the second guide hole. The plurality of liquid replenishment through holes can improve a speed of liquid supply.

In other solutions, the liquid replenishment one-way valve may also be a fluid control device, such as an electromagnetic valve and a one-way valve.

BRIEF DESCRIPTION OF THE DRAWINGS

The disclosure is further described hereinafter with reference to the drawings and embodiments.

DETAILED DESCRIPTION

Figure 1:
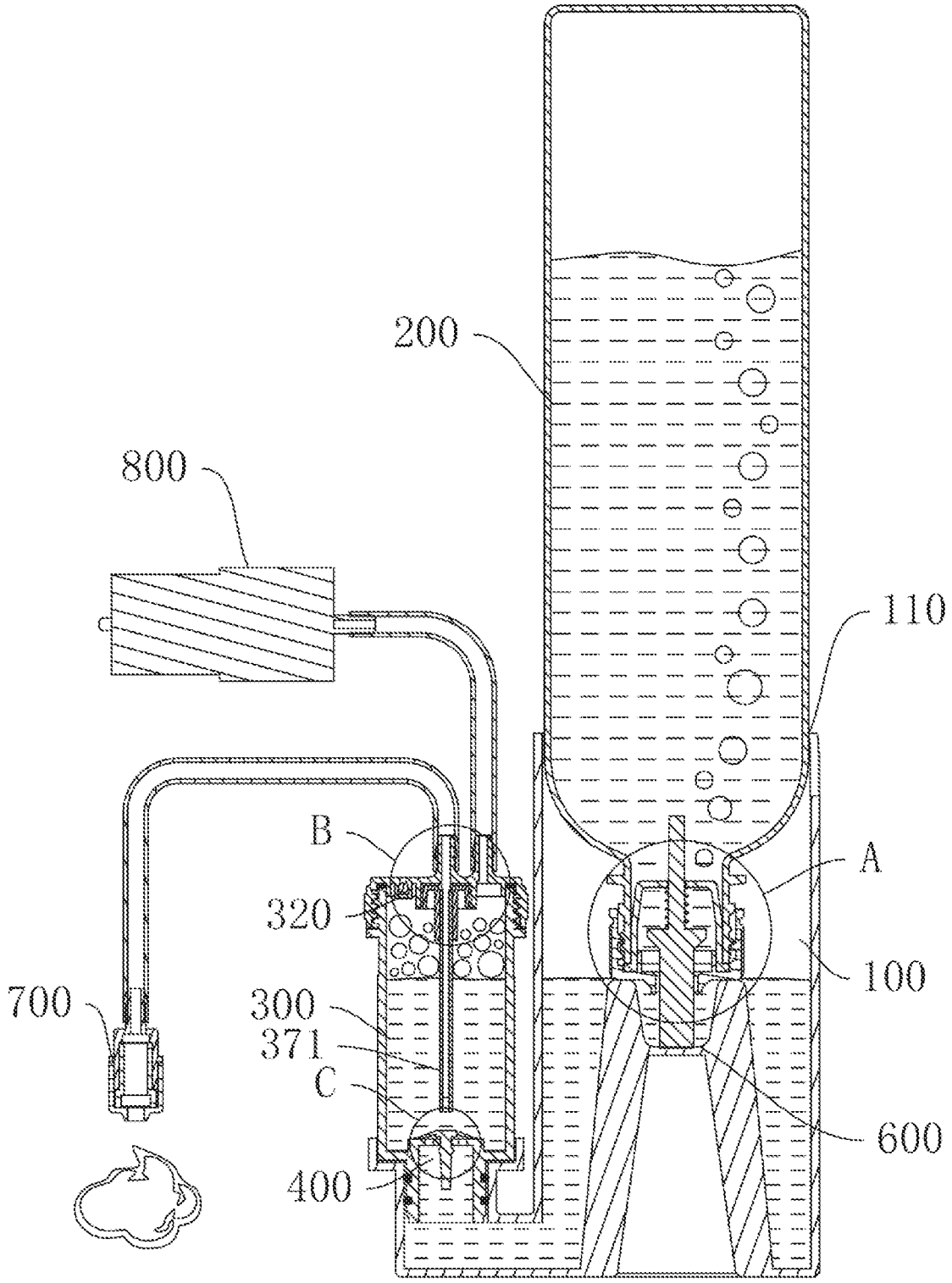
FIG. 1 is a sectional view of an underneath large-capacity single-gas-pump foam generating device provided according to an embodiment of the disclosure.
Figure 2:
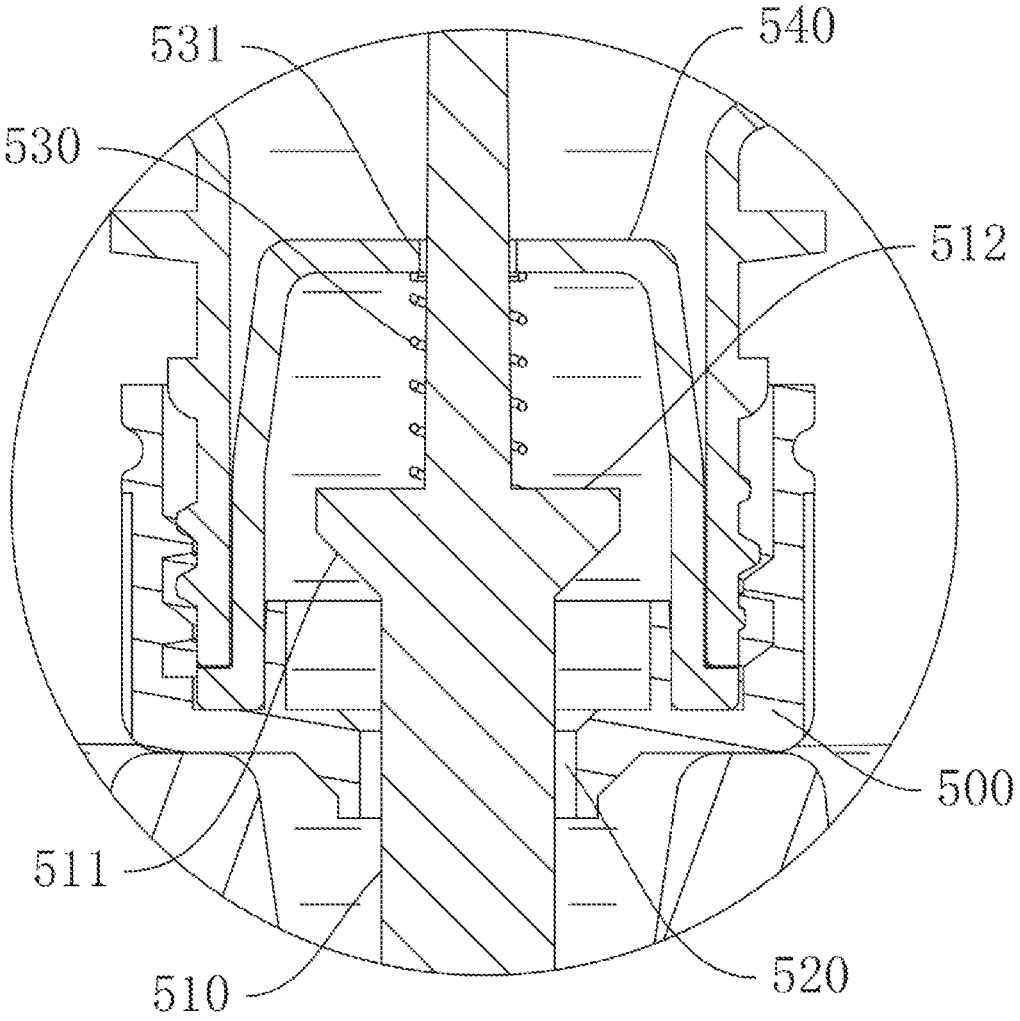
FIG. 2 is a partially enlarged view of a part A in FIG. 1.
Figure 3:
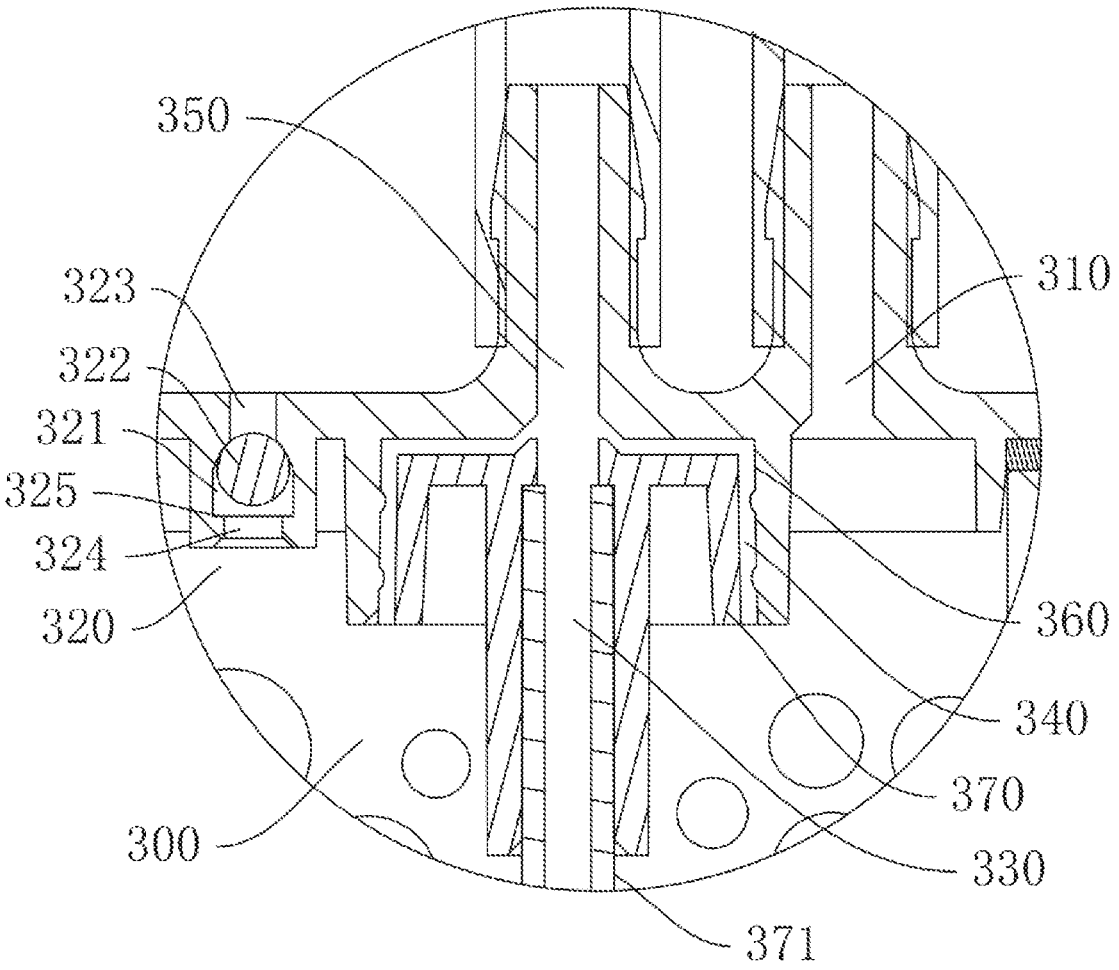
FIG. 3 is a partially enlarged view of a part B in FIG. 1.
Figure 4:
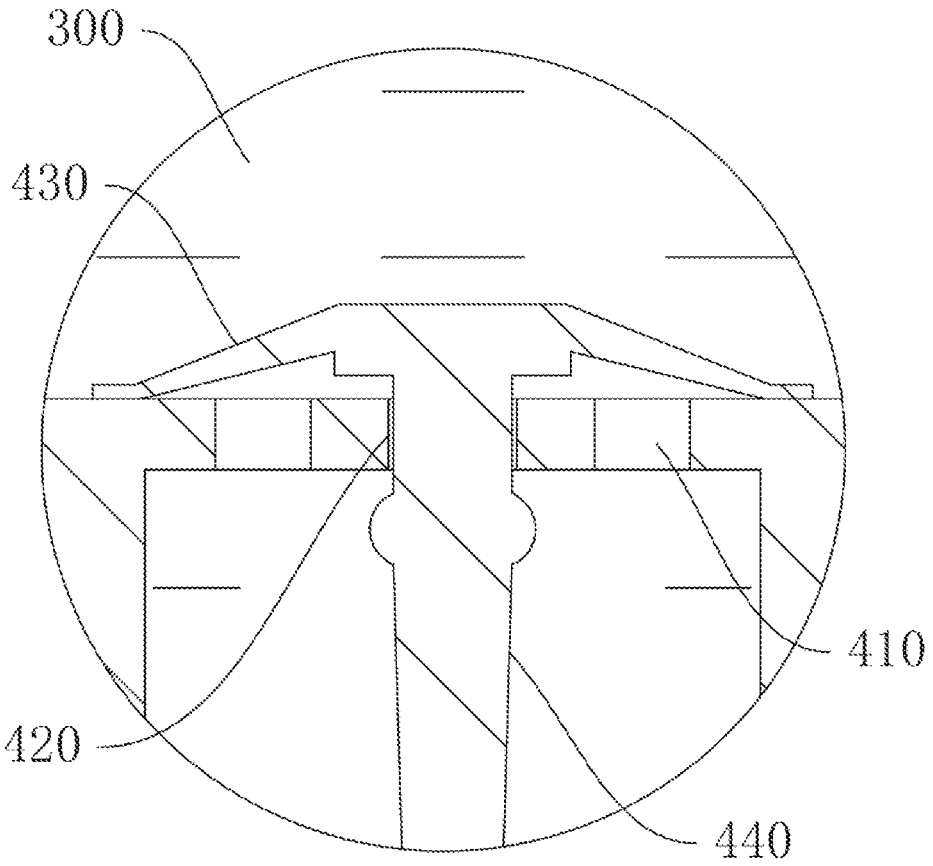
FIG. 4 is a partially enlarged view of a part C in FIG. 1.
Figure 5:
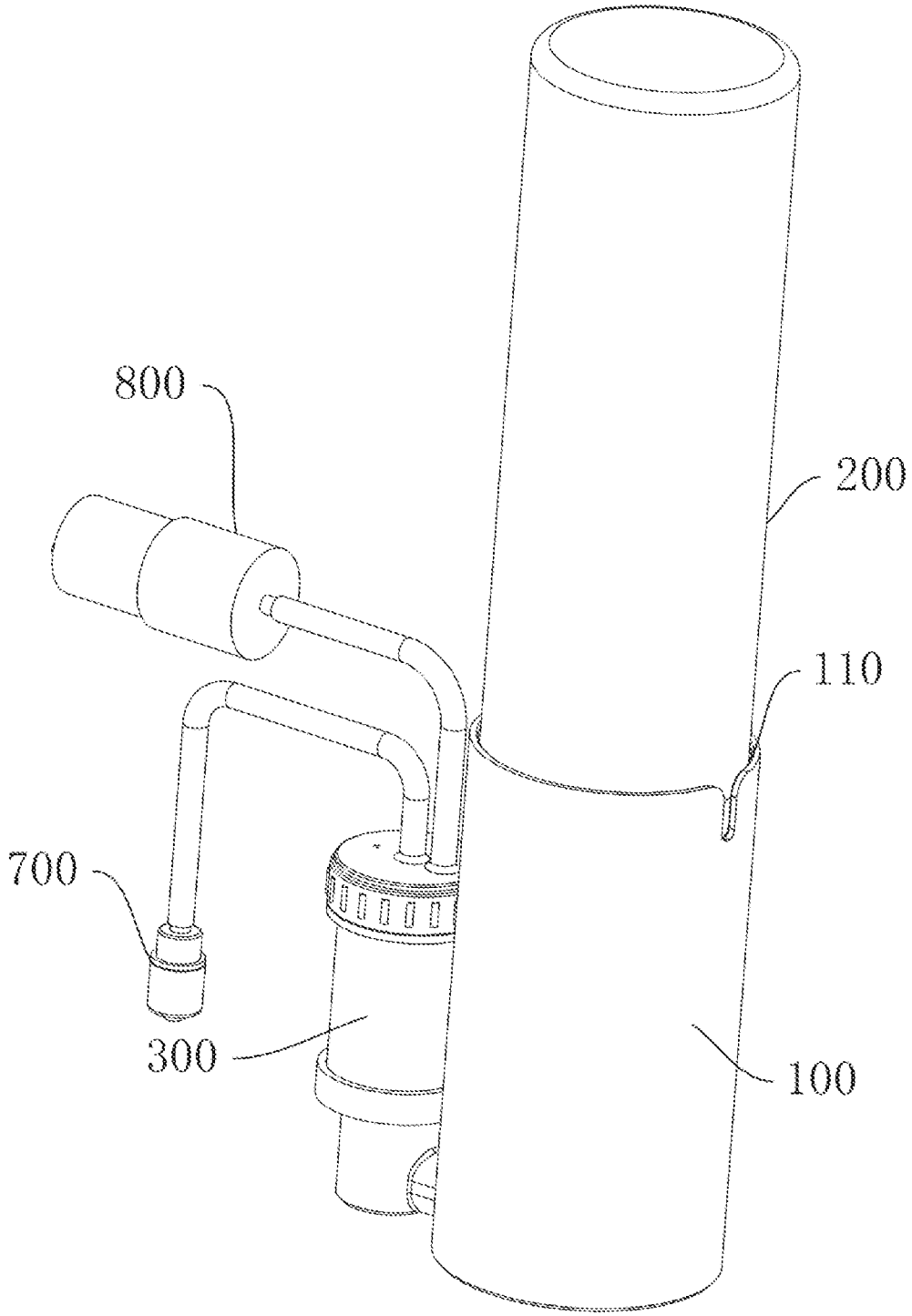
FIG. 5 is a schematic structural diagram of the underneath large-capacity single-gas-pump foam generating device provided according to an embodiment of the disclosure.

Specific embodiments of the disclosure will be described in detail in this part, preferred embodiments of the disclosure are shown in the drawings, and the drawings are intended to supplement the description in the written part of the specification with figures, so that people can intuitively and vividly understand each technical feature and the overall technical solution of the disclosure, but it cannot be understood as a limitation to the scope of protection of the disclosure.

In the description of the disclosure, it should be understood that, the orientation or position relationship related to the orientation description, such as the orientation or position relationship indicated by the terms "upper", "lower", "front", "rear", "left", "right", and the like is based on the orientation or position relationship shown in the drawings, which is only used for convenience of the description of the disclosure and simplification of the description instead of indicating or implying that the indicated device or element must have a specific orientation, and be constructed and operated in a specific orientation, and thus should not be understood as a limitation to the disclosure.

In the description of the disclosure, the term "several" if any refers to being one or more, the term "multiple" refers to being two or more, and the terms "greater than", "less than", "more than", and the like are understood as not including the following number, while the terms "above", "below", "within", and the like are understood as including the following number.

In the description of the disclosure, unless otherwise explicitly defined, the terms "setting", "mounting" and "connecting" should be understood in a broad sense, and those of ordinary skills in the art can reasonably determine the specific meanings of the above terms in the disclosure in combination with the specific contents of the technical solution.

With reference to FIG. 1 to FIG. 5, the following embodiments are made for an underneath large-capacity single-gas-pump foam generating device of the disclosure.

In an embodiment, the underneath large-capacity single-gas-pump foam generating device comprises a liquid replenishment mechanism and a foam generating mechanism.

The liquid replenishment mechanism comprises a liquid replenishment groove 100 and a liquid replenishment bottle 200, wherein the liquid replenishment groove 100 is provided with a sleeve port 110 with an upward opening, a lower end of the liquid replenishment bottle 200 is sleeved in the liquid replenishment groove 100 from the sleeve port 110, the liquid replenishment groove 100 is communicated with outside, and the lower end of the liquid replenishment bottle 200 is provided with a bottle opening.

The foam generating mechanism comprises a gas supply pump unit, a gas mixing groove cavity 300, a gas-liquid mixing structure arranged at an upper portion of the gas mixing groove cavity 300, a gas inlet 310 and a vent valve structure 320. A lower portion of the gas mixing groove cavity 300 is communicated with a lower portion of the liquid replenishment groove 100, a liquid replenishment one-way valve 400 is arranged between the gas mixing groove cavity 300 and the liquid replenishment groove 100, the liquid replenishment one-way valve 400 has a flowing direction from the liquid replenishment groove 100 to the gas mixing groove cavity 300, the gas supply pump unit is connected with the gas inlet 310, the vent valve structure 320 communicates the gas mixing groove cavity 300 with the outside, the gas-liquid mixing structure is provided with a liquid outlet channel 330, a gas outlet channel 340 and a mixing channel 350, an inlet end of the liquid outlet channel 330 extends downwardly into a bottom portion of the gas mixing groove cavity 300, an inlet end and a gas inlet 310 of the gas outlet channel 340 are both communicated with the upper portion of the gas mixing groove cavity 300, and an outlet end of the liquid outlet channel 330 and an outlet end of the gas outlet channel 340 are respectively communicated with an inlet of the mixing channel 350.

In an embodiment, the gas supply pump unit comprises a gas supply pump 800, the gas supply pump 800 is connected with the gas inlet 310 through a gas pipe, and is also provided with a foam refining unit 700, and the foam refining unit 700 is connected with an outlet of the mixing channel 350 through a pipeline.

When foam needs to be sprayed out, the gas supply pump unit performs air pressurization on the gas mixing groove cavity 300 to increase an internal pressure of the gas mixing groove cavity 300, the vent valve structure 320 is closed at the moment, a soap liquid in the gas mixing groove enters the mixing channel 350 from the liquid outlet channel 330 under the pressure, gas in the gas mixing groove cavity 300 enters the mixing channel 350 from the gas outlet channel 340 under the pressure at the same time, and the gas and the soap liquid are mixed in the mixing channel 350 to form the foam and then sprayed out of the mixing channel 350 together to realize foam spraying. After the soap liquid in the gas mixing groove cavity 300 is sprayed out, a liquid level of the soap liquid in the gas mixing groove cavity 300 will be lowered, the soap liquid in the liquid replenishment groove 100 is supplied into the gas mixing groove cavity 300 through the liquid replenishment one-way valve 400 under an action of an atmospheric pressure at the moment, until air pressure balance is reached between the gas mixing groove cavity 300 and the liquid replenishment groove 100, which means that liquid level heights of the gas mixing groove cavity 300 and the liquid replenishment groove 100 are consistent, and the vent valve structure 320 remains open at the moment to communicate the gas mixing groove cavity 300 with the outside. When the soap liquid in the liquid replenishment groove 100 is supplied to the gas mixing groove cavity 300, because the bottle opening at the lower end of the liquid replenishment bottle 200 is inserted into the liquid replenishment groove 100 from the sleeve port 110, the soap liquid in the liquid replenishment bottle 200 will be replenished into the liquid replenishment groove 100 when the liquid level in the liquid replenishment groove 100 is lowered, until the liquid level height in the liquid replenishment groove 100 exceeds the bottle opening, and then liquid replenishment is stopped, so as to ensure an amount of the soap liquid in the liquid replenishment groove 100. The foam generating device can generate foam through a single gas supply pump unit, and under the action of the atmospheric pressure, automatic liquid supply and replenishment can be realized among the liquid replenishment bottle 200, the liquid replenishment groove 100 and the gas mixing groove cavity 300 through a mechanical structure, so that large-capacity use can be realized, without needing frequent liquid replenishment.

The vent valve structure 320 comprises a vent channel 321 communicating the gas mixing groove cavity 300 with the outside and a counterweight blocking body 322 movably arranged in the vent channel 321 up and down. The vent channel 321 is provided with a vent outlet 323 and a vent inlet 324 which are arranged up and down, and the counterweight blocking body 322 is used for moving upwardly to block the vent outlet 323 under an force of high-pressure gas in the gas mixing groove cavity 300. In this embodiment, the vent valve structure 320 is mechanically closed through the counterweight blocking body 322. When the liquid replenishment groove 100 supplies liquid to the gas mixing groove cavity 300, an air pressure in the gas mixing groove cavity 300 is relatively low, and the counterweight blocking body 322 may be pushed up by the air pressure at the moment but is not pushed up to block the vent outlet 323, so that the vent channel 321 is in a communication state, the gas mixing groove cavity 300 is communicated with the outside at the moment, and the liquid replenishment groove 100 can supply liquid to the gas mixing groove cavity 300. When the gas supply pump unit performs air pressurization on the gas mixing groove cavity 300, the air pressure in the gas mixing groove cavity 300 is very high, and high-pressure gas may push the counterweight blocking body 322 up, so that the counterweight blocking body 322 blocks the vent outlet 323, the vent channel 321 is in a closed state at the moment, and the foam generating device is in a foam spraying state. A weight of the counterweight blocking body 322 may be determined by those of ordinary skills in the art according to an actual working air pressure, which will not be described in detail in the disclosure.

Moreover, the vent inlet 324 is provided with an annular bearing step 325 for supporting the counterweight blocking body 322, and the counterweight blocking body 322 is spherical. The annular bearing step 325 mainly serves to support the counterweight blocking body 322, thus avoiding the counterweight blocking body 322 from falling down, and ensuring that the counterweight blocking body 322 can be pushed up by the gas, wherein the vent outlet 323 has a trumpet-shaped structure with a small top and a large bottom. A vent gap is formed between the spherical counterweight blocking body 322 and an inner wall of the vent channel 321.

In an embodiment, the gas-liquid mixing structure comprises a sleeving groove 360 arranged in the top portion of the gas mixing groove cavity 300 and a hollow sleeving member 370 sleeved in the sleeving groove 360, the mixing channel 350 is arranged at a top portion of the sleeving groove 360 and communicated with the sleeving groove 360, the gas outlet channel 340 is arranged between an outer wall of the sleeving member 370 and an inner wall of the sleeving groove 360, the sleeving member 370 is connected with a liquid outlet pipe 371, and the liquid outlet channel 330 is formed in the liquid outlet pipe 371 and the sleeving member 370, thus being simpler in structure which can be manufactured without using a complicated mold.

Moreover, a plurality of gas outlet channels 340 are provided, and the plurality of gas outlet channels 340 are annularly arranged between the outer wall of the sleeving member 370 and the inner wall of the sleeving groove 360 at intervals. The plurality of gas outlet channels 340 can make the mixing of the gas and the soap liquid more uniform and sufficient, and the gas enters from a periphery of the mixing channel 350 to be mixed with the soap liquid.

Further, because the liquid replenishment bottle 200 is invertedly mounted, when the liquid replenishment bottle 200 is replaced, the soap liquid may be spilled out if there is still the soap liquid inside the liquid replenishment bottle. In order to avoid the soap liquid from being spilled out, the bottle opening is provided with the liquid replenishment valve structure, and the liquid replenishment groove 100 is provided with a liquid replenishment pushing structure for abutting against the liquid replenishment valve structure to open the liquid replenishment valve structure. The bottle opening is opened if the liquid replenishment pushing structure pushes the liquid replenishment valve structure up, and when the liquid replenishment pushing structure is separated from the liquid replenishment valve structure, the liquid replenishment valve structure closes the bottle opening. Specifically, the liquid replenishment valve structure comprises a liquid replenishment valve cover 500 sleeved on the bottle opening and a liquid replenishment valve core rod 510 arranged in an up-down extending mode, the liquid replenishment valve cover 500 is provided with a liquid replenishment valve port 520, a liquid replenishment elastic member 530 is arranged between the liquid replenishment valve core rod 510 and the liquid replenishment valve cover 500, an outer peripheral wall of the liquid replenishment valve core rod 510 is provided with a blocking step 511, the liquid replenishment elastic member 530 is used for providing a downward force to the liquid replenishment valve core rod 510, so that the blocking step 511 blocks the liquid replenishment valve port 520, and a lower end of the liquid replenishment valve core rod 510 extends out of the liquid replenishment valve port 520 to abut against the liquid replenishment pushing structure.

When the liquid replenishment valve structure is in a free state, the liquid replenishment elastic member 530 makes the blocking step 511 block the liquid replenishment valve port 520, and when a lower end of the liquid replenishment valve core rod 510 abuts against the liquid replenishment pushing structure and pushes the liquid replenishment valve core rod 510 up, the blocking step 511 is separated from the liquid replenishment valve port 520, so that the liquid replenishment valve port 520 is in a communication state.

A guide frame 540 is fixedly arranged on an inner side of the liquid replenishment valve cover 500, the guide frame 540 is provided with a first guide hole 531 in up-down sliding fit with an upper end of the liquid replenishment valve core rod 510, an outer periphery of the liquid replenishment valve core rod 510 is provided with an abutting step 512, and the liquid replenishment elastic member 530 is arranged between the abutting step 512 and a bottom portion of the first guide hole 531.

In an embodiment, the liquid replenishment pushing structure comprises a liquid replenishment pushing platform 600 arranged at a groove bottom of the liquid replenishment groove 100, and the liquid replenishment elastic member 530 is a spring arranged around the liquid replenishment valve core rod 510.

However, the liquid replenishment one-way valve 400 comprises an umbrella-shaped valve core arranged in an extending mode, and a liquid replenishment through hole 410 and a second guide hole 420 which are arranged at the top portion of the gas mixing groove cavity 300, the umbrella-shaped valve core comprises a valve cap 430 and a valve rod 440, the valve rod 440 is in up-down sliding fit with the second guide hole 420, the liquid replenishment through hole 410 is arranged below the valve cap 430, the liquid replenishment through hole 410 is communicated with the liquid replenishment groove 100, a plurality of liquid replenishment through holes 410 are provided, and the plurality of liquid replenishment through holes 410 are annularly arranged at intervals by taking an axis of the valve rod 440 as a center. The liquid replenishment one-way valve 400 is realized by the structure of the umbrella-shaped valve core, wherein the valve rod 440 is in sliding fit with the second guide hole 420. When in a free state, the umbrella-shaped valve core moves downwardly by a self-gravity, the valve cap 430 blocks the liquid replenishment through hole 410 at the moment, and when a liquid is supplied, the liquid may push the umbrella-shaped valve core up, and the valve cap 430 opens the liquid replenishment through hole 410 at the moment. A lower end of the valve rod 440 is provided with a limiting protrusion, which can avoid the umbrella-shaped valve core from being separated from the second guide hole 420. The plurality of liquid replenishment through holes 410 can improve a speed of liquid supply.

In some embodiments, the liquid replenishment one-way valve 400 may have other one-way valve structures, so long as one-way passage of the liquid can be realized.

Figure 6:
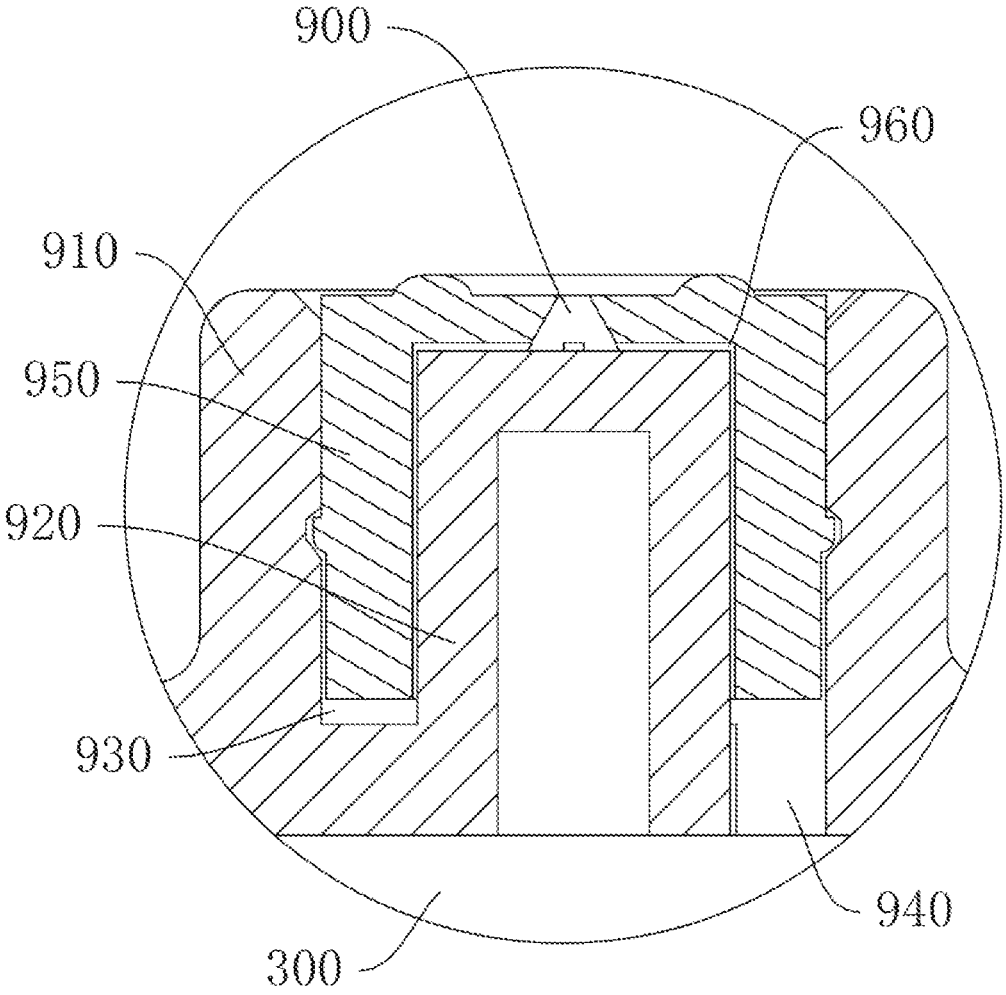
FIG. 6 is a sectional view of a vent valve structure provided according to an embodiment of the disclosure.

In other embodiments, the vent valve structure 320 may also have other structures, such as a micro vent hole structure 900, wherein the gas mixing groove cavity 300 is communicated with an external environment through the micro vent hole structure 900, and serves to provide air pressure balance, liquid replenishment and gas exhaust when the gas supply pump unit is not operated. When the gas supply pump unit pressurizes the gas mixing groove cavity 300, a small amount of air may be exhausted from the micro vent hole structure 900, but the small amount of air may be ignored and will not affect foam spraying. As shown in FIG. 6, a sleeve 910 is fixedly arranged on an outer wall of the upper portion of the gas mixing groove cavity 300, a sleeving column 920 fixed on the outer wall of the gas mixing groove cavity 300 is arranged in the sleeve 910, a sleeving gap 930 is formed between the sleeve 910 and the sleeving column 920, a bottom portion of the sleeving gap 930 is provided with a vent groove opening 940 communicated with the gas mixing groove cavity 300, an inverted barrel-shaped vent sleeve 950 is arranged in the sleeving gap 930, a top portion of the vent sleeve 950 is provided with the micro vent hole structure 900, an outer peripheral wall of the vent sleeve 950 hermetically abuts against an inner peripheral wall of the sleeve 910, a plurality of vent groove channels 960 are formed between an inner wall of the vent sleeve 950 and an outer wall of the sleeving column 920, and two ends of the vent groove channel 960 are respectively communicated with the micro vent hole structure 900 and the vent groove opening 940.

The above describes the preferred embodiments of the disclosure in detail, but the disclosure is not limited to the embodiments. Those of ordinary skills in the art may further make various equivalent modifications or substitutions without violating the gist of the disclosure, and these equivalent modifications or substitutions are all included in the scope defined by the claims of the present application.

What is claimed is:

1. An underneath large-capacity single-gas-pump foam generating device, comprising:

a liquid replenishment mechanism comprising a liquid replenishment groove and a liquid replenishment bottle, wherein the liquid replenishment groove is provided with a sleeve port with an upward opening, a lower end of the liquid replenishment bottle is sleeved in the liquid replenishment groove from the sleeve port, the liquid replenishment groove is communicated with outside, and the lower end of the liquid replenishment bottle is provided with a bottle opening; and a foam generating mechanism comprising a gas supply pump unit, a gas mixing groove cavity, a gas-liquid mixing structure arranged at an upper portion of the gas mixing groove cavity, a gas inlet and a vent valve structure, wherein a lower portion of the gas mixing groove cavity is communicated with a lower portion of the liquid replenishment groove, a liquid replenishment one-way valve is arranged between the gas mixing groove cavity and the liquid replenishment groove, the liquid replenishment one-way valve has a flowing direction from the liquid replenishment groove to the gas mixing groove cavity, the gas supply pump unit is connected with the gas inlet, the vent valve structure communicates the gas mixing groove cavity with the outside, the gas-liquid mixing structure is provided with a liquid outlet channel, a gas outlet channel and a mixing channel, an inlet end of the liquid outlet channel extends downwardly into a bottom portion of the gas mixing groove cavity, an inlet end of the gas outlet channel and the gas inlet are both communicated with the upper portion of the gas mixing groove cavity, and an outlet end of the liquid outlet channel and an outlet end of the gas outlet channel are respectively communicated with an inlet of the mixing channel, wherein the bottle opening is provided with a liquid replenishment valve structure, and the liquid replenishment groove is provided with a liquid replenishment pushing structure for abutting against the liquid replenishment valve structure to open the liquid replenishment valve structure.

2. The underneath large-capacity single-gas-pump foam generating device according to claim 1, wherein the vent valve structure comprises a vent channel communicating the gas mixing groove cavity with the outside and a counterweight blocking body movably arranged in the vent channel up and down, the vent channel is provided with a vent outlet and a vent inlet which are arranged up and down, the counterweight blocking body is used for moving upwardly to block the vent outlet under the force of high-pressure gas in the gas mixing groove cavity, the vent inlet is provided with an annular bearing step for supporting the counterweight blocking body, and the counterweight blocking body is spherical.

3. The underneath large-capacity single-gas-pump foam generating device according to claim 1, wherein the vent valve structure comprises a sleeve arranged on an outer wall of the upper portion of the gas mixing groove cavity, a sleeving column fixed on the outer wall of the gas mixing groove cavity is arranged in the sleeve, a sleeving gap is formed between the sleeve and the sleeving column, a bottom portion of the sleeving gap is provided with a vent groove opening communicated with the gas mixing groove cavity, an inverted barrel-shaped vent sleeve is arranged in the sleeving gap, a top portion of the vent sleeve is provided with a micro vent hole structure, an outer peripheral wall of the vent sleeve hermetically abuts against an inner peripheral wall of the sleeve, a plurality of vent groove channels are formed between an inner wall of the vent sleeve and an outer wall of the sleeving column, and two ends of each of the vent groove channels are respectively communicated with the micro vent hole structure and the vent groove opening.

4. The underneath large-capacity single-gas-pump foam generating device according to claim 1, wherein the gas-liquid mixing structure comprises a sleeving groove arranged in the top portion of the gas mixing groove cavity and a hollow sleeving member sleeved in the sleeving groove, the mixing channel is arranged at a top portion of the sleeving groove and communicated with the sleeving groove, the gas outlet channel is arranged between an outer wall of the sleeving member and an inner wall of the sleeving groove, the sleeving member is connected with a liquid outlet pipe, and the liquid outlet channel is formed in the liquid outlet pipe and the sleeving member.

5. The underneath large-capacity single-gas-pump foam generating device according to claim 4, wherein a plurality of the gas outlet channels are provided, and the plurality of gas outlet channels are annularly arranged between the outer wall of the sleeving member and the inner wall of the sleeving groove at intervals.

6. The underneath large-capacity single-gas-pump foam generating device according to claim 1, wherein the liquid replenishment valve structure comprises a liquid replenishment valve cover sleeved on the bottle opening and a liquid replenishment valve core rod arranged in an up-down extending mode, the liquid replenishment valve cover is provided with a liquid replenishment valve port, a liquid replenishment elastic member is arranged between the liquid replenishment valve core rod and the liquid replenishment valve cover, an outer peripheral wall of the liquid replenishment valve core rod is provided with a blocking step, the liquid replenishment elastic member is used for providing a downward force to the liquid replenishment valve core rod, so that the blocking step blocks the liquid replenishment valve port, and a lower end of the liquid replenishment valve core rod extends out of the liquid replenishment valve port to abut against the liquid replenishment pushing structure.

7. The underneath large-capacity single-gas-pump foam generating device according to claim 6, wherein a guide frame is fixedly arranged on an inner side of the liquid replenishment valve cover, the guide frame is provided with a first guide hole in up-down sliding fit with an upper end of the liquid replenishment valve core rod, an outer periphery of the liquid replenishment valve core rod is provided with an abutting step, and the liquid replenishment elastic member is arranged between the abutting step and a bottom portion of the first guide hole.

8. The underneath large-capacity single-gas-pump foam generating device according to claim 1, wherein the foam generating mechanism further comprises a foam refining unit, the foam refining unit is connected with an outlet of the mixing channel through a pipeline, the gas supply pump unit comprises a gas supply pump, and the gas supply pump is connected with the gas inlet through a gas pipe.

9. The underneath large-capacity single-gas-pump foam generating device according to claim 1, wherein the liquid replenishment one-way valve comprises an umbrella-shaped valve core arranged in an extending mode, and a liquid replenishment through hole and a second guide hole which are arranged at the top portion of the gas mixing groove cavity, the umbrella-shaped valve core comprises a valve cap and a valve rod, the valve rod is in up-down sliding fit with the second guide hole, the liquid replenishment through hole is arranged below the valve cap, the liquid replenishment through hole is communicated with the liquid replenishment groove, a plurality of the liquid replenishment through holes are provided, and the plurality of liquid replenishment through holes are annularly arranged at intervals by taking an axis of the valve rod as a center.

* * * * *